US008029628B2

(12) United States Patent
Tanaka et al.

(10) Patent No.: US 8,029,628 B2
(45) Date of Patent: Oct. 4, 2011

(54) NOBLE METAL ALLOY FOR SPARK PLUG AND METHOD FOR PRODUCING AND PROCESSING THE SAME

(75) Inventors: Kunihiro Tanaka, Isehara (JP); Koichi Sakairi, Hiratsuka (JP); Kenichi Kurihara, Hiratsuka (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 8 days.

(21) Appl. No.: 12/064,665

(22) PCT Filed: Jul. 24, 2007

(86) PCT No.: PCT/JP2007/064482

§ 371 (c)(1), (2), (4) Date: Aug. 12, 2009

(87) PCT Pub. No.: WO2008/013159

PCT Pub. Date: Jan. 31, 2008

(65) Prior Publication Data

US 2009/0293995 A1 Dec. 3, 2009

(30) Foreign Application Priority Data

Jul. 25, 2006 (JP) ..... P2006-202471
Apr. 3, 2007 (JP) ..... P2007-097465

(51) Int. Cl.
*C22C 5/04* (2006.01)

(52) U.S. Cl. ..... 148/430; 148/678; 420/461

(58) Field of Classification Search ..... 148/430, 148/678; 420/461

See application file for complete search history.

(56) References Cited

U.S. PATENT DOCUMENTS

| | | | | |
|---|---|---|---|---|
| 4,743,793 | A | 5/1988 | Toya et al. | 313/141 |
| 4,786,267 | A | 11/1988 | Toya et al. | 445/7 |
| 7,279,827 | B2 | 10/2007 | Nunome et al. | 313/141 |
| 2003/0155849 | A1 | 8/2003 | Hori | 313/141 |
| 2005/0168121 | A1 | 8/2005 | Tinwell | 313/141 |
| 2006/0061250 | A1 | 3/2006 | Yoshimoto et al. | 313/141 |
| 2006/0165554 | A1 * | 7/2006 | Coupland et al. | 420/461 |
| 2007/0222350 | A1 * | 9/2007 | Lykowski et al. | 313/141 |

FOREIGN PATENT DOCUMENTS

| | | |
|---|---|---|
| DE | 288113 | 3/1991 |
| EP | 0243529 | 11/1987 |
| EP | 1517419 | 3/2005 |

(Continued)

*Primary Examiner* — Roy King
*Assistant Examiner* — Janelle Morillo
(74) *Attorney, Agent, or Firm* — Roberts & Roberts, LLP

(57) ABSTRACT

An object of the present invention is to provide a material for a precious metal tip of a spark plug, which has more excellent durability, particularly oxidation wear resistance than a conventional one. The precious metal alloy for the spark plug according to the present invention contains 0.2 to 6.0 wt. % Cr as an essential component, further at least any one of Fe or Ni, and the balance being Ir. Here, the amount of Fe and Ni to be added is preferably 2.0 to 12.0 wt. % in total. According to the present invention, the surface may be oxidized to form an oxide layer made from a Cr—Fe oxide, a Cr—Ni oxide or a Cr—Fe—Ni oxide. The oxide layer is formed by a diffusion treatment by heating the precious metal alloy at 300 to 900° C. in an oxidative atmosphere, and preferably has a thickness of 5 to 100 μm.

17 Claims, 1 Drawing Sheet

FOREIGN PATENT DOCUMENTS

| | | |
|---|---|---|
| EP | 1628375 | 2/2006 |
| GB | 2302367 | 1/1997 |
| JP | 50-77738 | 6/1975 |
| JP | 1-319284 | 12/1989 |
| JP | 5-054955 | 3/1993 |
| JP | 07-268574 | 10/1995 |
| JP | 2002-198158 | 7/2002 |
| JP | 2006-233270 | 9/2006 |
| WO | WO2004/105204 | 12/2004 |
| WO | WO2005/083855 | 9/2005 |

* cited by examiner

NOBLE METAL ALLOY FOR SPARK PLUG AND METHOD FOR PRODUCING AND PROCESSING THE SAME

TECHNICAL FIELD

The present invention relates to a precious metal alloy suitable as a material for a precious metal tip, which is attached to the tip of a center electrode of a spark plug. The present invention also provides a preferable method for producing and working the precious metal alloy.

BACKGROUND ART

A spark plug which is used in an internal combustion engine of an automobile and the like has a precious metal tip fixed on the tip for the purpose of improving the durability of the center electrode. A particularly useful material for the precious metal tip is iridium or an alloy thereof. For instance, Patent Document 1 describes a precious metal tip made from iridium, and Patent Document 2 describes a precious metal tip made from an alloy of iridium and nickel.

Patent Document 1: Japanese Patent Laid-Open No. 5-054955

Patent Document 2: Japanese Patent Laid-Open No. 1-319284

The precious metal tip is used for the purpose of improving durability, but a material which composes the tip is required to have excellent spark wear resistance, oxidation wear resistance and chemical resistance. This is because a spark plug is a component for generating a spark and thereby causing combustion in an internal combustion engine, accordingly is exposed to impact caused by the spark or to a high-temperature and highly oxidative atmosphere, and further contacts chemicals such as fuel or an oil additive.

DISCLOSURE OF THE INVENTION

Problems to be Solved by the Invention

Iridium or an iridium alloy which is a material for a precious metal tip has been conventionally considered to tolerably satisfy the above described various characteristics, but a more excellent alloy is necessary when considering that a spark plug is demanded to have a further extended life. Iridium is chemically stable particularly in terms of oxidation resistance, but still can hardly inhibit oxidation from progressing in the environment in which the spark plug is used. Iridium oxide produced by the oxidation of iridium volatilizes at high temperature, so that the precious metal tip is worn out after a long period of use. Accordingly, a countermeasure against wearing due to such oxidation becomes necessary.

For this reason, the present invention is directed at providing a material for the precious metal tip of the spark plug, which has more excellent durability, particularly oxidative wear resistance than a conventional one.

Means for Solving the Problems

The present invention for solving the above described problem is a precious metal alloy for a spark plug, which contains 0.2 to 6.0 wt. % Cr as an essential component, further at least any one of Fe or Ni, and the balance being Ir.

An iridium alloy according to the present invention contains Cr (chromium) as an essential component for an alloying element in iridium, and further contains at least any one of Fe (iron) or Ni (nickel). The alloy according to the present invention is the precious metal alloy in which Cr and Fe, Cr and Ni, or Cr, Fe and Ni are alloyed into Ir, and forms a film made from a Cr—Fe oxide, a Cr—Ni oxide or a Cr—Fe—Ni oxide on the surface, when having been oxidized. The oxide film has no volatility in the environment in which the plug is used, consequently does not vanish even at high temperature, and accordingly can inhibit the iridium alloy of a base material from wearing to allow the tip to be used for a long period.

In the process in which the above described oxide film is formed, Cr, Fe and Ni in the alloy diffuse to the surface of the alloy, and each element including Ir existing on the surface is oxidized to form the oxide film. Accordingly, an intermediate layer in which Cr, Fe and Ni as well as oxygen are enriched in an Ir matrix is formed in between an oxide layer and the Ir alloy matrix. This intermediate layer secures the adhesiveness of the film which is a complete oxide, and becomes a supply source for a new oxide when the film has vanished. Specifically, even when a part or majority of the oxide film has exfoliated due to vibration or impact, the intermediate layer promptly becomes an oxide to inhibit the alloy from wearing.

As described above, the Ir alloy according to the present invention shows superior wearing resistance in a high-temperature oxidative atmosphere due to the characteristics of the oxide film to be formed thereon, and a self-recovery action of the film based on a diffusion phenomenon occurring inside the oxide film. The presence of Cr is greatly involved in these actions, so that Cr is an indispensable component.

As for the composition of the Ir alloy according to the present invention, the Ir alloy contains 0.2 to 6.0 wt. % Cr as the essential component. This is because when the Ir alloy contains less than 0.2 wt. % of Cr, the Ir alloy does not show the above described function, and because when the Ir alloy contains more than 6.0% of Cr, the melting point of the Ir alloy lowers, which affects spark wear resistance. The content of Cr is preferably 0.5 to 6.0 wt. %. This is because the Ir alloy having the above content tends to easily form a stronger oxide film thereon.

On the other hand, when any one or both elements of Fe and Ni are added into the alloy, the total amount of additional elements is preferably 2.0 to 12.0 wt. % and further preferably 5.0 to 12.0 wt. %. This is because when the amount of these added elements is less than 2.0 wt. %, the oxide film is not formed into sufficient thickness, because when the amount exceeds 12.0 wt. %, the spark wear resistance is affected and the workability is also remarkably lowered. When the amount is 5.0 wt. % or more, the oxide film is formed into sufficient thickness and accordingly can effectively inhibit the oxidative wear of iridium.

The Ir alloy according to the present invention preferably further contains 0.5 to 15 wt. % Rh (rhodium). This is because the addition inhibits the increase of the discharge voltage of the spark plug and improves the workability of the precious metal alloy. When the amount of added Rh is less than 0.5 wt. %, the workability is not expected to be enhanced, and even though the amount exceeds 15 wt. %, there is no problem in particular, but the workability tends to be hardly enhanced and the cost increases.

A spark plug is manufactured by using the Ir alloy which has been produced and worked with the above described method, and is used in a high-temperature and highly oxidative atmosphere. Then, an oxide film is formed on the surface of a precious metal tip made from the alloy according to the present invention immediately after having been used, according to the above described mechanism.

In addition, the Ir alloy according to the present invention having the oxide layer previously formed thereon can also be used. In this case, the oxide film formed of a Cr—Fe oxide, a Cr—Ni oxide or a Cr—Fe—Ni oxide is formed by subjecting the Ir alloy to a diffusion process of heating the Ir alloy at 300 to 900° C. in an oxidative atmosphere. The oxide layer formed by the post diffusion process is preferably ranged from 5 to 100 μm in thickness. This is because when the oxide film is less than 5 μm in thickness, the oxide film has no protective function, and because the oxide-film thickness exceeding 100 μm is prone to be exfoliated by impact or the like. The oxide layer preferably has the thickness in a range of 10 to 50 μm.

The Ir alloy according to the present invention can be produced by the steps of mixing constituent metals, melting the mixture and casting the molten metal. A usable spark plug is manufactured from the obtained Ir alloy by the steps of forming the obtained Ir alloy into a plate or a wire rod, and machining it into a precious metal tip with a method of cutting the plate or the wire rod into a desired length or the like.

A precious metal alloy having a high melting point according to the present invention can be melted and cast by a method of charging a raw material into a crucible, and heating the raw material with a high-energy beam such as an electric arc. However, the melting method by irradiating the raw material with the high-energy beam has difficulty in uniformly and wholly melting a large amount of the raw material, and may cause non-uniformity in the alloy composition. Particularly, a material for a plug which is an application object of the precious metal alloy according to the present invention is manufactured from a long wire rod, but it is necessary to melt and cast a correspondingly large amount of the raw material in order to manufacture the long wire rod.

For this reason, the method of producing and working the Ir alloy according to the present invention was decided to employ the steps of: preparing powders or small pieces of metals composing the alloy; heating them with a high-frequency induction heating method to melt it; casting the molten metal into two or more marble ingots having a small diameter; abutting the marble ingots to each other, and melting a contacting part to join and integrate the marble ingots; and plastic-working the integrated ingot.

The high-frequency induction heating is a method of introducing the raw material to be melted into a high-frequency coil, passing an electric current to the coil, and melting the raw material by induction heating. The method can uniformly melt the raw material in the coil and produce the marble ingot of high quality free from segregation and the like. The wire rod which keeps the uniformity of a composition/structure can be obtained by melting and joining a plurality of the marble ingots and working the joined material.

A basic configuration of an apparatus to be used in a production process according to the present invention includes an alternating current power supply and a coil. A usable material for a crucible to be used in a casting step for accommodating a raw material contains: graphite; and an oxide such as alumina, magnesia and calcia. An electric source used in a melting step shall have an output of 1 to 100 kW depending on the composition of the raw material to be melted. The frequency is set according to the size of the raw material. When marble ingots are produced, the preferable frequency is in a range of 30 to 500 kHz. The coil to be used is a molded copper pipe and is provided with a water-cooling mechanism.

A usable high-frequency induction heating method includes a levitation melting and casting method. The levitation melting and casting method is a method in which an electric current is passed to the coil with the use of a water-cooled copper crucible, and the raw material is melted in a state of being levitated by a Lorentz force which has been generated between an eddy current induced in the copper crucible and an eddy current passing through the raw material. By the method, the ingot of high purity can be produced without making the molten raw material contact with the crucible.

When the marble ingot is produced through a casting process with the use of the high-frequency induction heating method, it is preferable to control the weight of the marble ingot to 5 to 500 g. This is because when the weight is less than 5 g, it is necessary to produce a large number of the marble ingots, which is troublesome, and because when the weight exceeds 500 g, it is difficult to produce the marble ingot with the use of the high-frequency induction heating method due to a large consumption of the facility energy.

It is preferable to use an appropriate die (mold) for integrating the plurality of marble ingots. The internal shape of the die is preferably a rod shape in which a ratio (an aspect ratio) of a square root of the cross-sectional area to the length is 1:3 to 1:20. A method of melting the contacting parts between the plurality of the marble ingots upon integrating the marble ingots is preferably a method of heating the ingots by using a high energy beam such as a laser beam and an electron beam. An arc melting method can be also employed conveniently.

The integrated marble ingots can be subjected to plastic forming through one or more processes of forging, rolling, swaging and drawing. The rolling process includes a rolling process by using a flat roll, and in addition a groove rolling process by using a grooved roll. The marble ingot can be worked into a wire rod with a well-known method such as a hot swaging process or the like. The workpiece may be heat-treated on the way of being worked. A working temperature (hot and cool) while the workpiece is worked can be appropriately selected according to a processing rate and the like.

When the workpiece formed through a plurality of working methods, the workpiece may be heat-treated in between the processes. The heat treatment is performed, for instance, after the marble ingots have been integrated and the integrated ingot has been hot-forged, for the purpose of controlling a crystalline structure and removing a working distortion. Then, the hot-forged workpiece obtains a wholly uniform structure including joined parts (melted parts). Then, by rolling the heat-treated workpiece, the material can be prevented from being fractured or forming flaw due to the working processes. The heat treatment is performed at 800 to 1,700° C. in many cases, though depending on a composition of the material of an objective product, a recrystallization temperature and the like.

BEST MODE FOR CARRYING OUT THE INVENTION

Preferred embodiments according to the present invention are described below.

First Embodiment

In the present embodiment, an Ir—Cr—Fe alloy, an Ir—Cr—Ni alloy, and an Ir—Cr—Fe—Ni alloy having various compositions respectively were produced, and the oxidative wear resistance was evaluated. Each alloy was produced with the following method.

Small pieces of Ir, Cr, Fe, Ni, and Rh (with sizes of 2 mm to 10 mm) were prepared as a raw material, and were charged into a water-cooled copper mold so as to form such an alloy composition as shown in Table 1. Then, the small pieces were melted in an inert gas with a high-frequency induction heating method (levitation melting method), and were cast. The small pieces were wholly melted with an output of 50 kW and a frequency of 250 kHz so as to form an alloy having a uniform composition. After the alloy had been melted, the molten alloy was slowly cooled at a cooling velocity of 200° C./min by controlling the output, and remaining gases were exhausted. Then, the marble ingots without voids (with diameter of 15 mm and thickness of 8 mm) were produced. Six marble ingots with the same size were produced by repeating the casting process. Next, the produced marble ingots were placed in the water-cooled copper die with a width of 20 mm and a length of 100 mm so as to contact with each other, and the contacting parts were irradiated with argon arc to be melted and joined.

The integrated marble ingot was hot-forged at 1,500° C. into an ingot with a size of 12 mm per side. Subsequently, the ingot was subjected to a groove rolling step, a swaging step and a dice drawing step to have formed a wire rod with a diameter of 0.6 mm. The workpiece was heat-treated at 1,400° C. in nitrogen in the step at which the area reduction ratio reached 20% to 30% on the way of those working steps. A precious metal tip with a length of 0.8 mm was cut out from the wire rod.

Figure 1:
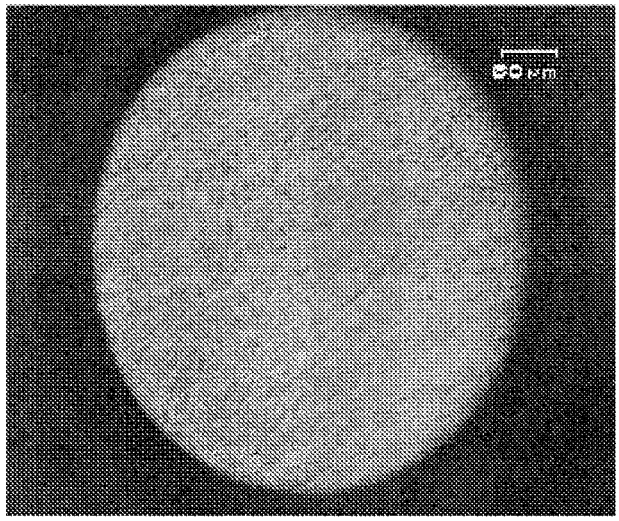
FIG. 1 is a photograph illustrating a cross-sectional structure of the material of a produced and worked wire rod according to the present embodiment.

In the above described working steps, no remarkable crack or fracture was observed in the wrought material. As a result of having observed the metallographic structure of the wrought wire rod, the material showed a structure comprising crystal grains with a uniform size. FIG. 1 illustrates the cross-sectional structure of the material of the wrought wire rod.

The oxidation wear resistance of the manufactured precious metal tip was evaluated. In addition, an oxide film was preliminarily formed on some precious metal tips by diffusion treatment prior to the evaluation. This treatment was performed by heating the tip at 500° C. for 1 hour in the atmosphere.

The oxidation resistance of the precious metal tip was evaluated by the steps of: heating the tip at 1,300° C. in the atmosphere for ten hours; measuring the change of the mass during being heated with TG-DTA; and determining the mass change per hour. In addition, the wear level of the tip after the test was observed and the wear level thereof was evaluated.

The alloys evaluated in the present embodiment and the results are shown in Table 1. Table 1 shows evaluation results of precious metal tips made from Ir, an Ir—Ni alloy, and an Ir—Fe alloy with a conventional technology, for the purpose of comparison.

TABLE 1

| | Alloy composition (wt. %) | | | | Rate of change of | |
|---|---|---|---|---|---|---|
| | Fe | Ni | Cr | Ir | mass (%) | Appearance* |
| Example 1 | 10 | — | 1 | balance | −0.02 | ○ |
| Example 2 | 12 | — | 1 | balance | 0.00 | ○ |
| Example 3 | — | 10 | 1 | balance | −0.01 | ○ |
| Example 4 | — | 12 | 1 | balance | 0.00 | ○ |
| Example 5 | 5 | 1 | 1 | balance | −0.03 | ○ |
| Example 6 | 8 | 2 | 2 | balance | 0.00 | ○ |

TABLE 1-continued

| | Alloy composition (wt. %) | | | | Rate of change of | |
|---|---|---|---|---|---|---|
| | Fe | Ni | Cr | Ir | mass (%) | Appearance* |
| Example 7 | 0.5 | 0.5 | 6 | balance | −0.06 | ○ |
| Example 8 | 8 | 5 | 1 | balance | −0.02 | Δ |
| Comparative Example 1 | — | — | — | balance | −0.27 | X |
| Comparative Example 2 | — | 12 | — | balance | −0.27 | X |
| Comparative Example 3 | 10 | 2 | — | balance | −0.22 | X |
| Comparative Example 4 | 10 | — | 0.1 | balance | −0.23 | X |
| Comparative Example 5 | 6 | 2 | 7 | balance | −0.03 | X |

○: wearing state showing uniform and smooth surface and side face
Δ: wearing state showing rough state in one part of surface and side face
X: wearing state showing remarkably rough state on surface and side face As is understood from Table 1, the precious metal tips made from an Ir alloy essentially containing Cr in Examples 1 to 8 prepared in the present embodiment showed an extremely small mass loss, and it was confirmed that the precious metal tips had superior oxidation wear resistance in a high-temperature oxidative atmosphere. In addition, the precious metal tips showed a comparatively smooth appearance though having a change of hue. On the other hand, Comparative Examples 1 to 3 which do not contain Cr and Comparative Examples 4 and 5 which contain Cr exceeding a range of 0.2 to 6.0 wt. % were prone to cause a mass loss and showed a remarkably roughened appearance.

In addition, it has been found that even though the Cr content is within 0.2 to 6.0 wt. %, an alloy containing less than 2.0 wt. % Fe and Ni in total as in Example 7 is prone to cause the mass loss, and on the other hand, that an alloy containing Fe and Ni exceeding 12.0 wt. % in total as in Example 8 shows an appearance of a rough state in one part, though showing a small mass loss.

Figure 2:
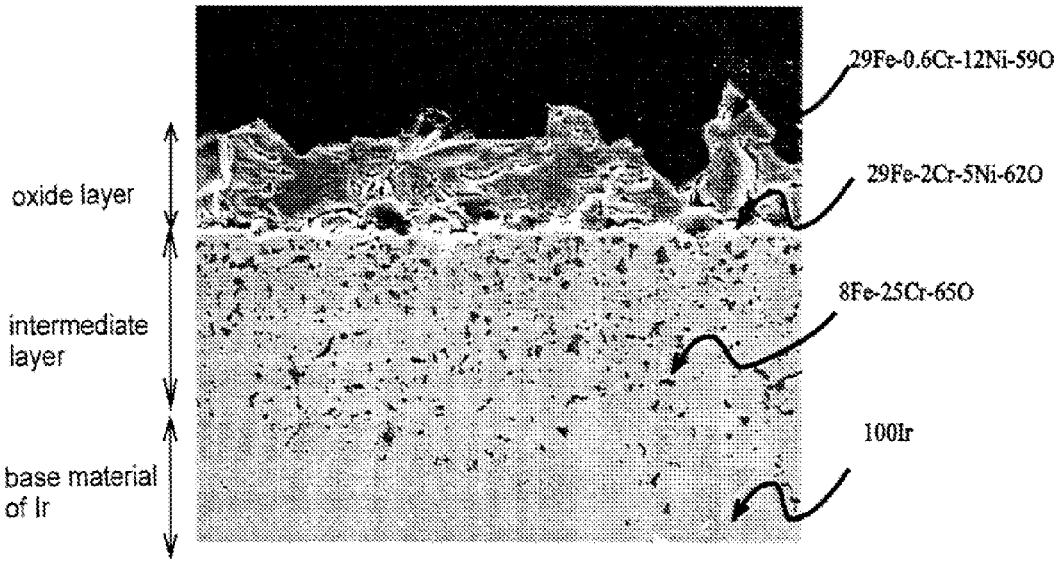
FIG. 2 is a photograph illustrating the cross section of a precious metal tip according to Example 6.

FIG. 2 is a photograph of a precious metal tip according to Example 6 after an evaluation test and a quantitative analysis value of each part. It is understood from the figure that a ternary oxide film is formed on the surface of the precious metal tip of Example 6 after having been oxidized, and that a layer of enriched Fe and Cr is formed as an intermediate layer.

Second Embodiment

In the present embodiment, an Ir—Cr—Rh—Fe alloy, an Ir—Cr—Rh—Ni alloy, and an Ir—Cr—Rh—Fe—Ni alloy having various compositions respectively were produced, and precious metal tips were manufactured by using the alloys as a raw material with the same method as in the first embodiment. The oxidation wear resistance of the obtained precious metal tip was evaluated with the same method as the method described above.

TABLE 2

| | Alloy composition (wt. %) | | | | | Rate of change of | Discharge voltage |
|---|---|---|---|---|---|---|---|
| | Fe | Ni | Cr | Rh | Ir | mass (%) | (kV) |
| Example 9 | 2 | — | 0.3 | 1 | balance | −0.09 | 2.65 |
| Example 10 | — | 5 | 1 | 5 | balance | −0.03 | 2.61 |
| Example 11 | 4 | 0.5 | 1 | 5 | balance | −0.04 | 2.62 |
| Example 12 | 5 | — | 5 | 10 | balance | 0.00 | 2.52 |
| Example 13 | 4 | 3 | 3 | 12 | balance | 0.00 | 2.54 |

TABLE 2-continued

| | Alloy composition (wt. %) | | | | | Rate of change of | Discharge voltage |
|---|---|---|---|---|---|---|---|
| | Fe | Ni | Cr | Rh | Ir | mass (%) | (kV) |
| Example 14 | 4 | 0.5 | 1 | — | balance | −0.04 | 2.74 |
| Comparative Example 1 | — | — | — | — | 100 | −0.27 | 2.93 |

As is understood from Table 2, the precious metal tips made from an Ir alloy containing Rh in Examples 9 to 13 prepared in the present embodiment showed a smaller mass loss than that of Comparative Example 1, and it was confirmed that the precious metal tips had superior oxidation wear resistance in a high-temperature oxidative atmosphere. The Examples also showed low discharge voltage. On the other hand, it was found that Example 14 containing no Rh showed a somewhat increased discharge voltage though having showed a low rate of the change of the mass.

INDUSTRIAL APPLICABILITY

As described above, an Ir alloy according to the present invention has superior oxidation wear resistance in particular, because of being capable of forming an oxide film thereon having a superior effect of protecting a base material due to the action of Cr in the alloy. The Ir alloy also reliably has other durabilities such as spark wear resistance equivalent to or better than those of a conventional material by controlling a Cr concentration into an appropriate range. Accordingly, a spark plug can extend the life by providing a precious metal tip made from the Ir alloy according to the present invention, in the center electrode.

The invention claimed is:

1. A precious metal alloy for a spark plug, consisting of 0.2 to 6.0 wt. % Cr, Fe, and Ni, and the balance being Ir, wherein the precious metal alloy has an oxide layer made from a Cr—Fe oxide, a Cr—Ni oxide or Cr—Fe—Ni oxide formed on a surface thereof.

2. The precious metal alloy according to claim 1, wherein the content of Fe and Ni is 2.0 to 12.0% wt. in total.

3. The precious metal alloy according to claim 1, consisting of 0.2 to 6.0 wt. % Cr, Fe, and Ni, and 0.5 to 15 wt. % Rh, and the balance being Ir.

4. The precious metal alloy according to claim 1, wherein the oxide layer has a thickness of 5 to 100 μm.

5. The metal alloy according to claim 1, wherein the oxide layer is formed via a diffusion treatment in which the precious metal alloy is heated in an oxidative atmosphere at 300 to 900° C.

6. The precious metal alloy according to claim 3, wherein the content of Fe and Ni is 2.0 to 12.0% wt. in total.

7. The precious metal alloy according to claim 2, wherein the oxide layer has a thickness of 5 to 100 μm.

8. The precious metal alloy according to claim 3, wherein the oxide layer has a thickness of 5 to 100 μm.

9. The metal alloy according to claim 2, wherein the oxide layer is formed via a diffusion treatment in which the precious metal alloy is heated in an oxidative atmosphere at 300 to 900° C.

10. The metal alloy according to claim 3, wherein the oxide layer is formed via a diffusion treatment in which the precious metal alloy is heated in an oxidative atmosphere at 300 to 900° C.

11. The metal alloy according to claim 4, wherein the oxide layer is formed via a diffusion treatment in which the precious metal alloy is heated in an oxidative atmosphere at 300 to 900° C.

12. The metal alloy according to claim 7, wherein the oxide layer is formed via a diffusion treatment in which the precious metal alloy is heated in an oxidative atmosphere at 300 to 900° C.

13. The metal alloy according to claim 8, wherein the oxide layer is formed via a diffusion treatment in which the precious metal alloy is heated in an oxidative atmosphere at 300 to 900° C.

14. A method for producing and working a precious metal alloy comprising the steps of:

subjecting powders or small pieces of metals constituting the alloy consisting of 0.2 to 6.0 wt. % Cr, Fe, and Ni, and the balance Ir, to a high-frequency induction heating treatment to melt them and form a molten metal, and casting the molten metal into two or more marble ingots;

abutting the marble ingots to each other, and melting a contacting part to join and integrate the marble ingots; and subjecting the integrated ingot to plastic working; and forming an oxide layer made from a Cr—Fe oxide, a Cr—Ni oxide or Cr—Fe—Ni oxide on a surface thereof.

15. The method for producing and working the precious metal alloy according to claim 14, wherein the plastic working process comprises one or more working steps of forging, rolling, swaging and drawing.

16. The method for producing and working the precious metal alloy according to claim 15, wherein heat treatment is performed in an inert or reductive atmosphere in any of the working steps of forging, rolling, swaging and drawing.

17. The method for producing and working the precious metal alloy according to claim 14, wherein the marble ingot has a weight of 5 to 500 g.

* * * * *